United States Patent [19]

Knaap

[11] Patent Number: 4,512,244

[45] Date of Patent: Apr. 23, 1985

[54] VENTILATION GRATING FOR USE IN WINDOW FRAMES TOGETHER WITH SEALED UNIT INSULATING GLASS

[75] Inventor: Jan J. Knaap, Haren, Netherlands

[73] Assignee: Kateka B.V., Netherlands

[21] Appl. No.: 554,601

[22] Filed: Nov. 23, 1983

[51] Int. Cl.[3] ..... F24F 13/18

[52] U.S. Cl. ..... 98/98; 49/38

[58] Field of Search ..... 98/415 V, 88 R, 98, 98/99 R, 99.6, 99.8; 49/38

[56] References Cited

FOREIGN PATENT DOCUMENTS

| | | | |
|---|---|---|---|
| 1454613 | 2/1969 | Fed. Rep. of Germany | 98/99 R |
| 1934996 | 1/1971 | Fed. Rep. of Germany | 98/99 R |
| 7903032 | 10/1980 | Netherlands | 98/98 |
| 7906375 | 2/1981 | Netherlands | 49/38 |
| 1433405 | 4/1976 | United Kingdom | 98/88 R |
| 2011608 | 7/1979 | United Kingdom | 49/38 |

*Primary Examiner*—Harold Joyce

*Attorney, Agent, or Firm*—Winburn & Gray, Ltd.

[57] ABSTRACT

A closable ventilation grating of the type having two grids, one being slidable along the other, which is adapted for use with sealed unit insulating glass is disclosed. The grating comprises a lower, hollow member which has parallel pending flanges for mounting the grating on sealed unit insulating glass. The grating also comprises grids which are easily adaptable to a desired length as they are comprised of a number of similar, standardized sections and a standardized operating section where required.

6 Claims, 7 Drawing Figures

VENTILATION GRATING FOR USE IN WINDOW FRAMES TOGETHER WITH SEALED UNIT INSULATING GLASS

The invention relates to a closable ventilation grating for attachment against a head piece of a window frame, comprising a rectangular frame consisting of an upper hollow profile portion, a lower hollow profile portion both made of a metal, and left and right end portions each provided with lugs that may be fittingly pushed in the corresponding ends of the upper and lower profile portions to form the rectangular frame; in the frame further being mounted two grids having similar vent openings, one of the grids being slidable along the other in order to control the amount of ventilation; the grids being made of the same material as the left and right end portion of the rectangular frame.

Such a ventilation grating has been disclosed in British Pat. No. 2,011,608 issued to Kateka B. V.

The prior art ventilation grating has upper and lower profile portions made of aluminium, while the grids and the left and right end portions of the rectangular frame are made of synthetic material, so that in case of heating of the ventilation grating by solar heat the slidable grid will not become jammed.

Further because of the fact that the rectangular frame is composed of four members, of which the upper and lower member may be cut from a length of profile at any desired length, the prior art ventilation grating has the advantage that is may be easily adapted to any size of window frame. Thus for the manufacturer there is no need to have in stock a large number of ventilation gratings having different standard dimensions.

The prior art ventilation grating however has been essentially designed for use with normal single paning, although a possibility for adaptation to insulating glass has indeed been disclosed in British Pat. No. 2,011,608.

Nowadays more and more insulating glass is being used and a need is felt for a ventilation grating of the kind as disclosed in British Pat. No. 2,011,608 which has been especially designed for use together with sealed unit insulating glass.

Thus it is an object of the present invention to provide a ventilation grating of the above described kind which is suitable for use with sealed unit insulation glass.

It is a further object of the invention to provide a ventilation grating of which not only the upper and lower frame members may be easily adapted to the desired length, but also the grids.

The invention will now be explained by way of example, with reference to the accompanying drawings, wherein.

Figure 1:
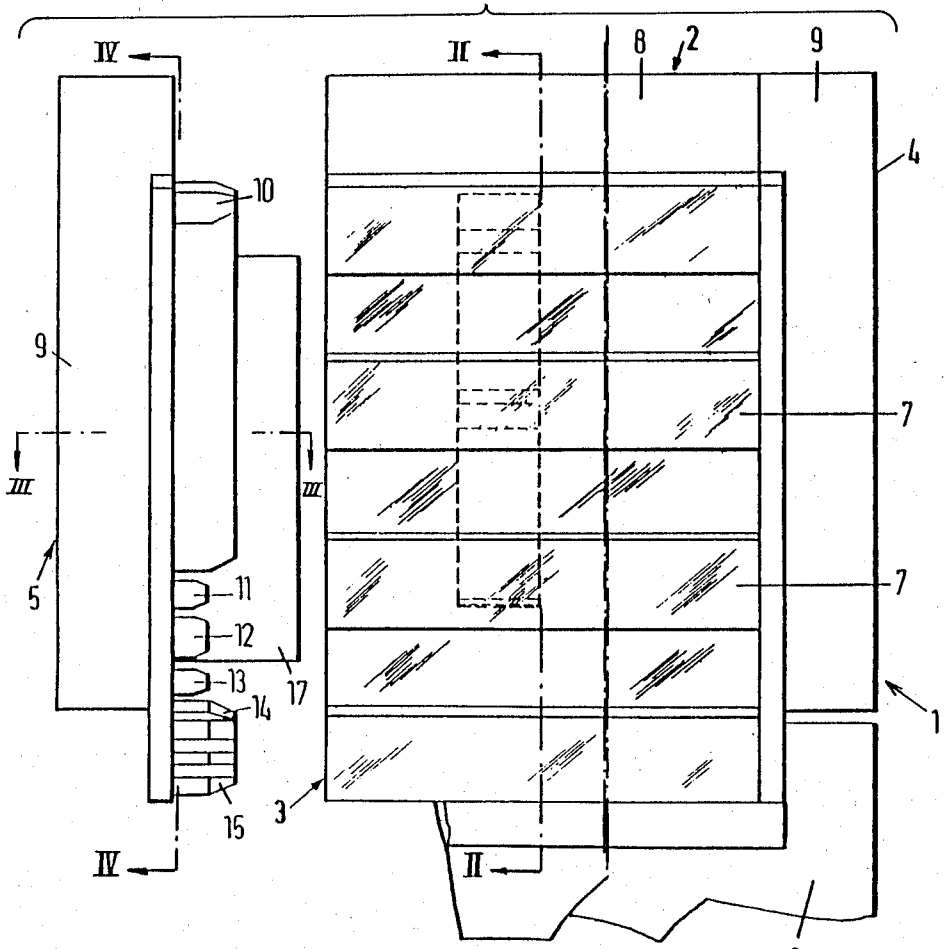
FIG.1 PRIOR ART
FIG. 1 shows a front view of the prior art ventilation grating, with the left end frame member in extended position.

FIG. 1 shows a front view of a prior art ventilation grating, indicated by 1, comprising a rectangular frame of which the upper member and the lower member are indicated by 2 resp. 3. Further, the right-hand end member 4 is shown in its mounted position. The left-hand end member 5 has been shown separately. A single pane on which the ventilation grating may be mounted is indicated by 6.

As the ventilation grating has been provided with Z-shaped anti-drip members at the side of the grating facing outward, which members have been indicated by 7 in FIG. 1, the grids are not visible in FIG. 1.

The upper and lower frame members are preferably made of a suitable hollow aluminium profile. The upper frame member has a flat flange 8, that together with similar flanges 9 of the left and right end members defines a flat plane in which also the pane 6 lies, as may be seen in FIG. 2.

The end members 4 and 5 as well as the grids are preferably made of nylon or other suitable synthetic material.

Figure 2:
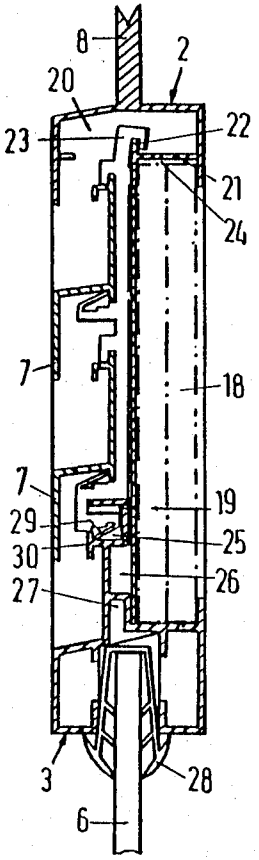
FIG. 2 PRIOR ART.
FIG. 2 shows a cross-section along the line II—II in FIG. 1.
Figure 3:
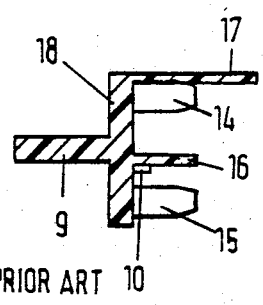
FIG. 3 shows a cross-section along the line III—III in FIG. 1.

FIG. 2 shows a cross-section along the line II—II in FIG. 1, and FIG. 3 shows a cross-section along the line III—III in FIG. 1 of the left-hand end member 5, it being understood that the end members are counterparts but furthermore formed identically.

For the sake of completeness the end members will now be described with reference to FIGS. 1–3.

Described on the basis of end member 5, there can be distinguished then on each end member, besides the flat flange 9, a coupling lug 10 which is adapted to be fittingly pushed in the leading end in the cavity 20 in the upper profile 2, and the coupling lugs 11, 12, 13, 14 and 15 into corresponding cavities in the leading end of the lower profile 3, as shown in FIG. 2, so that a connection between the upper and lower profiles is obtained.

Furthermore the end member 5 comprises a supporting fillet 16 where against are positioned the drip members 7 with the ends thereof and are supported thereby, and a fillet 17 serving to mask the ends of the grids 18, 19 (FIG. 2), so that for instance the effect of not entirely identical grid length is concealed from view. The web 18 serves for further shutting off the leading ends of the ventilation grating.

The upper profile 2 at the side facing towards the grating, is accessible to a limited extent and comprises a T-shaped moulding 21 right-angled to the grill plane, the collar 22 of which may serve for attachment of a strap 23. The T-shaped moulding 21 furthermore constitutes a downwardly open chamber 24 adapted to serve as top guide for the grid members 18, 19 of synthetic material containing co-linear ventilation slots, the member 18 of which is adapted to be slid along the stationary member 19 through means, not shown, thereby shutting off or releasing the slots, while the members 18, 19 at the bottom thereof are recessed in a cross-sectionally U-shaped part of the top face of lower profile 3 as lower guide.

The top face of lower profile 3 is furthermore so formed, that open ended channels 25,26,27 are available for introducing therein the coupling lugs 11,12,13 of end member 5.

At the bottom of the lower profile there is formed in longitudinal direction a slot for accommodation therein of the single paning 6 through application of the dry paning principle by means of a flexible sealing member 28.

For protection of the ventilation slots against seepage, there are disposed drip members 7 facing towards the atmosphere.

The attachment of the drip members 7 takes place through the intermediary of a plurality of straps 23. Of such a strap the hookshaped top end embraces collar 22. The bottom end of the strap has a U-shape in cross-section, whereby the legs of the U are right-angled to the longitudinal direction of the strap while the opening of the U is facing towards the ventilation members 18, 19. The lower edge of the U contains a resilient lip 29 extending obliquely downwardly from the opening of the U. The access to the channel 25 is provided with a threshold 30. After the coupling of the strap at the top side thereof about collar 22, the U-shaped end of the strap can be inserted in the channel 25, whereby the lip 29 is impressed in the direction of the outer wall of the U-shaped end by threshold 30. After the lip 29 has passed threshold 23, it springs back outwardly to about its original position while blocking the decoupling of the strap at the bottom end by contact against threshold 30. At the side of strap 23 facing towards the atmosphere, it contains at regular intervals a plurality of means for holding the drip members 7. The number of straps 21 to be used for attachment and support is determined by the width of the ventilation grating under consideration.

Figure 4:
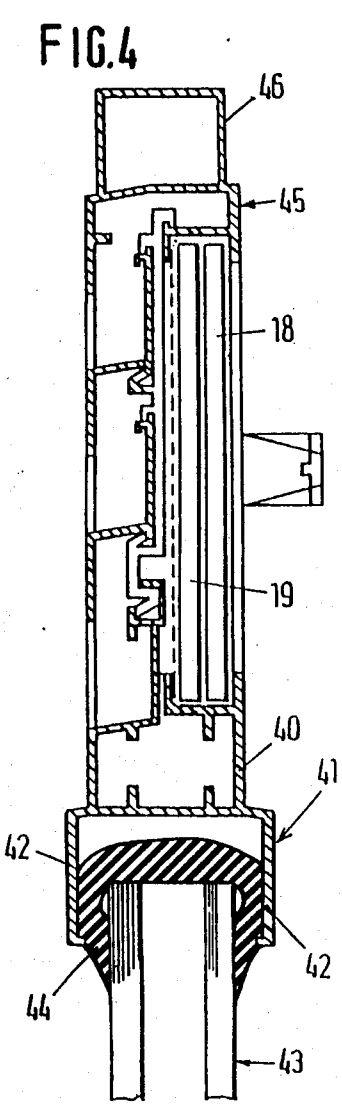
FIG. 4 shows a cross-section, corresponding to the cross-section of FIG. 2, of a ventilation grating according to the present invention.

FIG. 4 shows a cross-section, corresponding to the cross-section of FIG. 2, of an embodiment of a ventilation grating according to the present invention, which has been particularly designed for use with sealed unit insulating glass. The hollow lower profile 40 of the rectangular frame of the ventilation grating now comprises an inverted U-shaped part 41 formed by two pending parallel flat flanges 42 of the hollow profile 40. Between said flanges 42 the sealed unit insulating glass 43 may be inserted and sealed between the flanges by means of a suitable flexible sealing member 44.

The distance between the pending flanges 42 of course should be such that insulating glass of the desired thickness may suitably accommodated. Thus, if glass of a different thickness will be used, a ventilation grating having a corresponding differing distance between the flanges 42 should be used.

The hollow upper profile 45 corresponding to the upper profile 2 of FIG. 2 has according to the invention, been provided with an inverted U-shaped upper channel 46, having a thickness corresponding to the thickness of the insulating glass to be used.

Further the channel 46 has been located in such manner, that its vertical side walls essentially are flush with the inner and outer surfaces defined by the insulating glass to be used.

Figure 5:
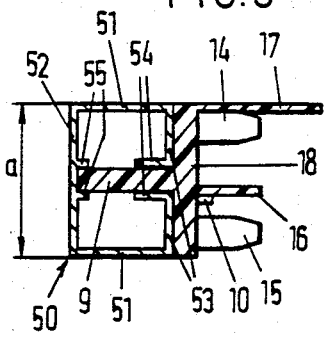
PRIOR ART FIG.5
FIG. 5 shows a cross-section, corresponding to the cross-section of FIG. 3, of a ventilation grating according to the present invention.

FIG. 5 shows in cross-sectional view an embodiment of the left-hand end member of a rectangular frame for a ventilation grating according to the present invention. The right-hand end member has a similar shape and has not been shown.

In the embodiment shown, the prior art end member has simply been provided with a U-shaped profile 50 of basically rectangular shape, that has been fittingly pushed on the flat flange 9 of the prior art end member. The profile 50 may be made from a suitable synthetic material just like the prior art end member, but preferably has been made from a metal e.g. aluminium, the rest of the end member still being of synthetic material.

The width "a" of the profile 50 corresponds to the thickness of the insulating glass to be used. Thus the width "a" may be different from the width of the web 18. Further the outer side legs 51 of the profile 50 are flush with the surfaces defined by the legs of the channel 46 of the upper profile and the insulating glass.

The profile 50 has a U-shaped cross-section, comprising a bottom web 52, two legs 51, the legs 51 at their free ends being bent inwardly over 90° to form two webs 53 parallel to the bottom web 52. The free ends of the webs 53 have been bent a second time over 90° to form two legs 54 parallel to the legs 51. Between the legs 54 a free space exists such that the profile 50 may be fittingly pushed over the flat flange 9, the legs 54 holding between them the flat flange 9.

Preferably two short flanges 55 have been formed on the inside of the bottom web. The flanges 55 also fit over the flat flange 9.

A ventilation grating according to the present invention may be installed by first mounting it with the inverted U-shaped profile 41 upon a sealed unit insulated glass pane of suitable dimensions and then installing the glass pane together with the ventilation grating in the window frame in conventional manner.

If the glass is to be mounted in the window frame with glazing bars, the glazing bars may extend over the ventilation grating upper and end frame members.

Further, as the profiles 50 are simply pushed upon the flat flanges 9, the end members 4 and 5 may freely expand and contract due to variations in temperature without a risk of jamming of the grids 18,19 in the frame.

The grids 18,19 each could be made in one piece. However, as at least one of the grids must be provided with oparating means, a rotating knob for instance, to be able to shift the grids in relation to each other, this would mean that each grid would have to be specially made in the length necessary for a specific ventilation grating.

According to the present invention the grids are composed of a number of similar, standardized sections, and in case of the grid provided with operating means, a standardized operating section.

Figure 6:
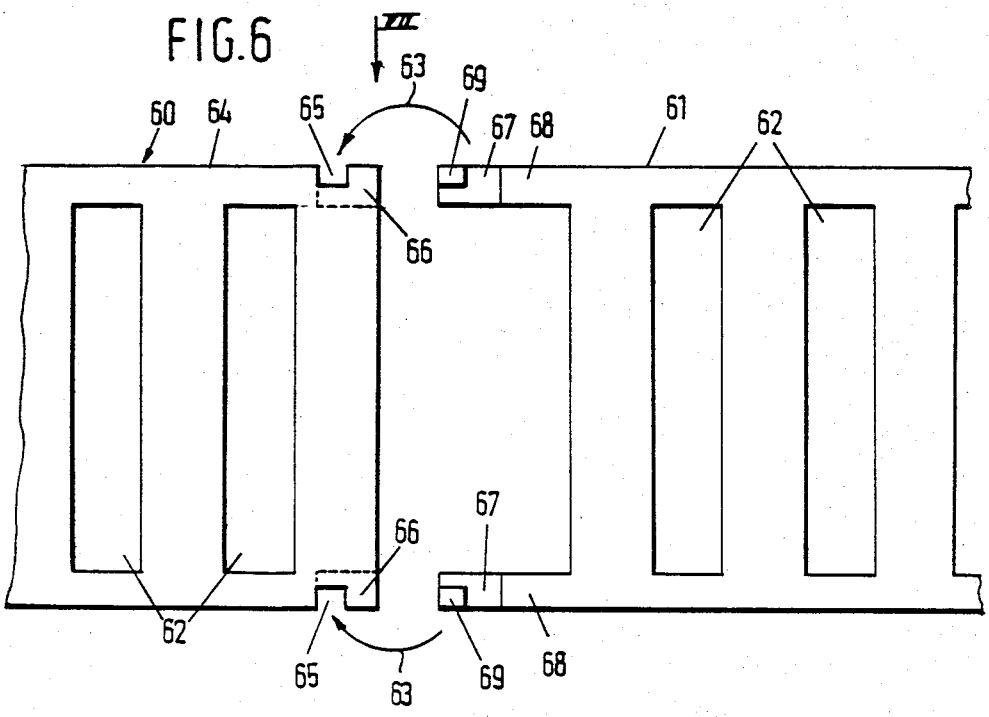
FIG. 6 shows a grid according to the present invention.
Figure 7:
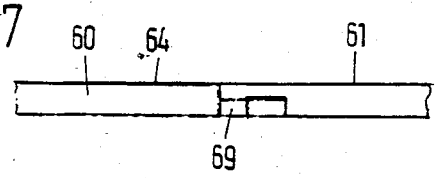
FIG. 7 shows a detail of FIG. 6.

In FIG. 6 two sections 60,61 of a grid have been partially shown. Each section has a number of rectangular ventilation passages 62 formed in a flat rectangular sheet of synthetic material. The sections 60,61 may be connected to each other as indicated by curved arrows 63 and as illustrated in FIG. 7, which shows a view according to arrow VII in FIG. 6 of the situation in which the two sections are connected to each other.

Section 60 has in its longitudinal upper and lower edges 64 near the end to be connected to section 61 a notch 65 of rectangular shape. Further the section 60 has an area 66, joining the notch, of half thickness in order to be able to form a half top joint together with a corresponding area 67 of half thickness of each of two legs 68 of the section 61 extending to the section 60. A small rectangular region 69 at the upper resp. lower corner of the legs 68 however, has the normal thickness. The shape of the region 69 corresponds to the shape of the notch 65, so that the region 69 may be hooked into the notch in order to connect the grid sections 60 and 61.

If a further section must be coupled to the section 61, the section 61 at its right-hand end of course must be provided with notches corresponding to the notches 65, and the further section is provided with legs and regions corresponding to the legs 68 and the regions 69.

As the grids are snugly held between flanges of the upper and lower profiles of the frame of the ventilation grating, the sections of the grids, once connected and mounted in the frame, cannot become disconnected.

I claim:

1. A closable ventilation grating for attachment against a head piece of a window frame comprising an upper hollow profile member, a lower hollow profile member both made of a metal, and left and right end members each provided with lugs that may be fittingly pushed into the corresponding ends of the upper and lower profile members to form a rectangular frame, said end members having outwardly directed flat flanges; in the frame further being mounted two grids having similar vent openings one of the grids being slidable along the other in order to control the amount of ventilation; the grids being made of the same material as the left and right end members of the rectangular frame, characterized in that (a) the lower profile member has been provided with two parallel pending flanges for mounting of the ventilation grating on sealed unit insulating glass;

(b) the upper profile member has been provided with an upper channel of rectangular inverted U-shape having a thickness corresponding to the thickness of the insulating glass to be used and being located such that the vertical side walls of the U-shaped channel essentially are flush with the inner and outer surfaces defined by the insulating glass;

(c) the end members each have been provided with a profile of basically rectangular cross-section, that may be fittingly pushed on the flat flanges, the cross-sectional width of the profile being equal to the thickness of the insulating glass to be used.

2. A ventilation grating according to claim 1, characterized in that the profile to be pushed on the flat flange of an end member is made of the same material as the upper and lower members of the frame.

3. A ventilation grating according to claim 1, characterized in that the profile to be pushed on the flat flange has a U-shaped cross-section, the legs of the U-shape at their free ends being bent inwardly over 90° to form two webs parallel to the bottom web of the U-shape, the two webs at their free ends being bent inwardly a second time over 90° to form two legs parallel to the legs of the U-shape and defining between them a slit in which the flat flange fits snugly.

4. A ventilation grating according to claim 3, characterized in that on the inside of the bottom web of the U-shape two short parallel flanges have been formed, defining between them a slit in which the flat flange fits.

5. A ventilation grating according to claim 1, characterized in that each of the two grids is composed of a number of sections of standardized length, each section at its ends to be coupled to another section being shaped with means that may be hooked on the other section.

6. A ventilation grating according to claim 5, characterized in that the end of one section to be coupled to a second section has a notch in each of its longitudinal edges near the end thereof and regions of half thickness adjoining the notches and extending to the end of the section, the second section having complementary regions of half thickness, a small part of each complementary region being of normal thickness and falling into the corresponding notch of said one section so as to form a half lap joint.

* * * * *